US007128410B2

(12) United States Patent
Levin et al.

(10) Patent No.: US 7,128,410 B2
(45) Date of Patent: Oct. 31, 2006

(54) INK JET PRINT HEAD CLEANING SYSTEM

(75) Inventors: Alexander M. Levin, Glenview, IL (US); Pietro Lostumbo, Bloomingdale, IL (US)

(73) Assignee: Videojet Technologies Inc., Wood Dale, IL (US)

( * ) Notice: Subject to any disclaimer, the term of this patent is extended or adjusted under 35 U.S.C. 154(b) by 302 days.

(21) Appl. No.: 10/802,256

(22) Filed: Mar. 17, 2004

(65) Prior Publication Data

US 2005/0206675 A1 Sep. 22, 2005

(51) Int. Cl.
*B41J 2/185* (2006.01)

(52) U.S. Cl. ..... 347/90

(58) Field of Classification Search ..... 347/76–78, 347/89, 90, 7, 28
See application file for complete search history.

(56) References Cited

U.S. PATENT DOCUMENTS 3,596,276 A * 7/1971 Lovelady et al. ..... 347/76
3,761,953 A * 9/1973 Helgeson et al. ..... 347/7
4,296,418 A * 10/1981 Yamazaki et al. ..... 347/28
4,528,996 A 7/1985 Jones (Continued)

FOREIGN PATENT DOCUMENTS

EP 1 170 130 1/2002
WO WO 93/17867 9/1993

(Continued)

OTHER PUBLICATIONS

"Videojet *Excel* Series Auto Flush Addendum", PIN 365322-01, Rev. CC Apr. 2002.

(Continued)

*Primary Examiner*—K. Feggins
(74) *Attorney, Agent, or Firm*—McAndrews, Held & Malloy, Ltd.

(57) ABSTRACT

Embodiments of the present invention provide a self-cleaning print head for an ink jet printer that directs ink to a substrate to be marked. The print head includes a ground plate having a channel formed therethrough, and a makeup fluid supply system that supplies makeup fluid directly to the ground plate through a makeup supply conduit, and into a catcher. The makeup fluid removes ink residue from the channel as the makeup fluid flows through the channel.

21 Claims, 3 Drawing Sheets

U.S. PATENT DOCUMENTS

| | | | | |
|---|---|---|---|---|
| 4,563,688 | A | 1/1986 | Braun | |
| 5,557,306 | A | 9/1996 | Fukushima et al. | |
| 5,581,282 | A | 12/1996 | Okamura | |
| 5,598,197 | A | 1/1997 | Zaba | |
| 5,877,788 | A | 3/1999 | Haan et al. | |
| 6,145,952 | A | 11/2000 | Sharma et al. | |
| 6,158,839 | A | 12/2000 | Fukushima et al. | |
| 6,254,216 | B1 | 7/2001 | Arway et al. | |
| 6,347,858 | B1 | 2/2002 | Faisst, Jr. et al. | |
| 6,406,122 | B1 | 6/2002 | Sharma et al. | |
| 6,435,647 | B1 | 8/2002 | Faisst, Jr. et al. | |
| 6,478,402 | B1 | 11/2002 | Greive | |
| 6,497,472 | B1 | 12/2002 | Sharma et al. | |
| 6,511,151 | B1 | 1/2003 | Griffin et al. | |
| 6,523,930 | B1 | 2/2003 | Griffin et al. | |
| 6,572,215 | B1 | 6/2003 | Sharma | |
| 6,575,556 | B1 * | 6/2003 | Eremity et al. | 347/28 |
| 6,595,617 | B1 | 7/2003 | Sharma et al. | |
| 2001/0043250 | A1 | 11/2001 | Faisst, Jr. et al. | |
| 2002/0075350 | A1 | 6/2002 | Sawicki | |
| 2002/0085058 | A1 | 7/2002 | Griffin et al. | |
| 2002/0122090 | A1 | 9/2002 | Sharma et al. | |
| 2002/0126174 | A1 | 9/2002 | Sharma et al. | |
| 2002/0186270 | A1 | 12/2002 | Sharma | |

FOREIGN PATENT DOCUMENTS

| | | |
|---|---|---|
| WO | WO 98/06583 | 2/1998 |
| WO | WO 99/62717 | 12/1999 |

OTHER PUBLICATIONS

Aug. 16, 2005 International Search Report and Written Opinion for PCT/EP2005/002750.

* cited by examiner

INK JET PRINT HEAD CLEANING SYSTEM

BACKGROUND OF THE INVENTION

Embodiments of the present invention generally relate to a print head for an ink jet printer, and particularly to an ink jet printer having a system for removing ink deposits and residue from a ground plate and catcher.

Conventional continuous ink jet printers supply electrically conductive ink under pressure to a drop generator, which has an orifice or orifices (nozzles) that are typically arranged in a linear array. The ink discharges from each orifice in the form of a filament, which subsequently breaks up into a droplet stream. Individual droplets in the stream are selectively charged in the region of the break off from the filament, and these charged drops are then deflected as desired by an electrostatic field. The deflected drops may proceed to a substrate, whereas undeflected drops are caught in a gutter or catcher and recirculated.

After the printer is shut down for a period of time, ink within the print head dries up, often partially blocking, and sometimes completely clogging, the outer openings to the orifices catcher, and other components therein. Furthermore, during a long shut down period, such as an entire day or weekend, the dried ink accumulates within the orifice or passages attached to the orifice, depending on the type of ink.

Known designs, such as those disclosed by U.S. Pat. Nos. 6,575,556, 5,877,788 and 4,528,996, are used to cleanse the orifices of the print heads. Additionally, a continuous ink jet printer having a print head that closes off the orifice to stop seepage of ink therethrough during periods when printing does not occur is disclosed in U.S. Pat. No. 5,598,197.

Typically, print head cleaning systems and methods are limited to the nozzle, or drop generator. However, ink deposits and residue also accumulate around the catcher and ground plate. Ink droplets often settle on and within the catcher. As ink deposits and residue accumulate on these components, printing quality suffers due to the clogging of the components and conduits therebetween, or due to interference between built-up residue and ink droplets. That is, the recycling rate of ink and other fluids through these components decreases as the accumulation of deposits and residue increases. Often, the ink jet printer is completely shut down in order for an operator to manually clean these components, thereby precluding use of the printer.

Thus, a need exists for a system and method of cleaning various components of a print head of an ink jet printer. Overall, a need exists for an efficient system and method of cleaning a print head of an ink jet printer.

SUMMARY OF THE INVENTION

Embodiments of the present invention provide a self-cleaning print head for an ink jet printer that directs ink to a substrate to be marked. The print head includes a drop generator for providing a droplet stream toward a substrate during a printing cycle, a charge electrode for selectively charging ink droplets in the droplet stream during the printing cycle, and a deflection plate and a ground plate having a channel formed therein. An electrostatic field is formed between the deflection plate and the ground plate to deflect charged droplets of ink toward the substrate during the printing cycle.

The print head also includes a catcher for receiving uncharged droplets of ink during the printing cycle, and a makeup fluid supply system that supplies makeup fluid directly to the ground plate through a makeup supply conduit during a cleaning cycle. As ink circulates in the system, the ink thickens due to normal evaporation. In order to compensate for the evaporation and maintain a suitable ink viscosity, makeup fluid is added to the ink by an ink control system. The makeup fluid is able to remove ink residue from the channel as the makeup fluid flows through the channel. The catcher receives the makeup fluid that flows through the channel during the cleaning cycle. That is, the makeup fluid is suctioned from the channel into the catcher. Further, embodiments of the present invention may include a system that deposits small amounts of makeup fluid around the mouth of the catcher, in order to clean that area and remove residue therefrom.

A makeup return system is operatively connected to the catcher through a makeup return conduit. The makeup fluid flows through the makeup return conduit to the makeup return system. The print head may also include a generator supply conduit, wherein the makeup fluid is directly supplied to the drop generator through the generator supply conduit, and wherein the makeup fluid is directly supplied to the ground plate through the makeup supply conduit. The makeup fluid may be supplied to the drop generator through a separate makeup fluid supply system.

Embodiments of the present invention also provide a method of automatically cleaning a print head of an ink jet printer. The method includes directly supplying makeup fluid to a ground plate in order to remove ink droplet residue from the ground plate, and suctioning the makeup fluid from the ground plate to a catcher, wherein the makeup fluid removes ink droplet residue from the catcher and around the mouth of the catcher.

Figure 1:
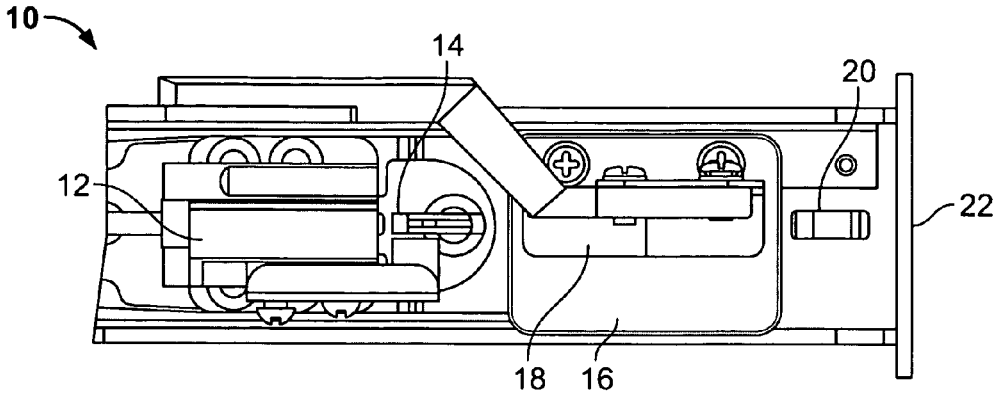
FIG. 1 illustrates a top view of a print head according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

Figure 2:
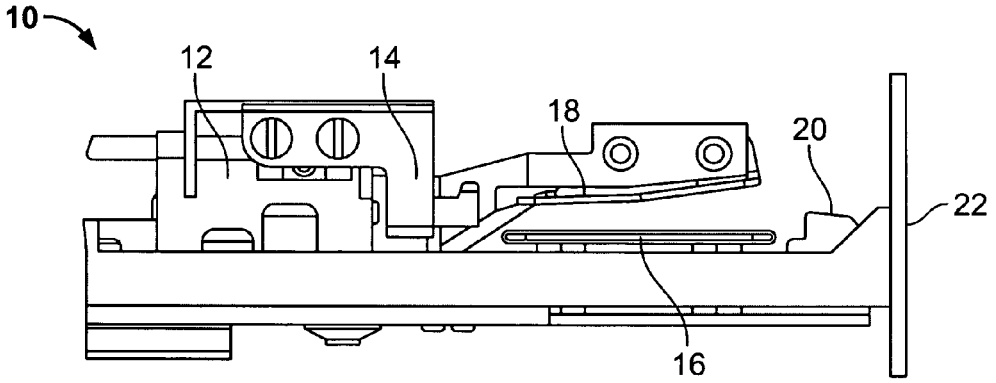
FIG. 2 illustrates a side view of a print head according to an embodiment of the present invention.

FIGS. 1 and 2 illustrate a print head 10 according to an embodiment of the present invention. The print head 10 includes a drop generator 12, a charge electrode 14, a ground plate 16, a high voltage deflection plate 18, and a catcher 20. The charge electrode 14, the ground plate 16, the high voltage deflection plate 18, and the catcher 20 are positioned between the drop generator 12 and a substrate (not shown), which is remotely located from the print head window 22. During printing, the drop generator 12 receives ink (not shown) from a main conduit (not shown) as shown and described in U.S. Pat. No. 6,575,556, entitled "Self-Cleaning Print Head for Ink Jet Printer," which is hereby incorporated by reference in its entirety. A piezoelectric cylinder (not shown) is bonded around the main conduit in order to impart vibrational energy of a selected frequency to the ink received by the drop generator 12. A droplet stream is thus created and selectively charged by the charge electrode 14. An electrostatic field formed between the deflection plate 18 and the ground plate 16 deflects the charged drops of ink over the catcher 20 and onto the substrate. Uncharged drops that pass between the deflection plate 18 and ground plate 16 are not deflected and pass directly into the catcher 20, which is vacuum assisted to recirculate the ink back into an ink reservoir (not shown).

Figure 3:
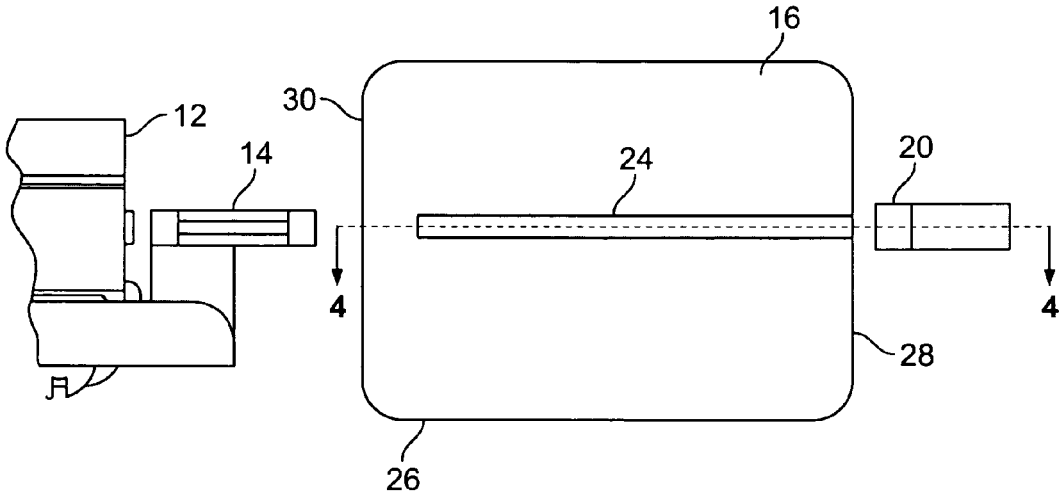
FIG. 3 illustrates a simplified top view of a print head according to an embodiment of the present invention.

FIG. 3 illustrates a simplified top view of the print head 10. As shown in FIG. 3, a channel 24 is formed in the ground plate 16. The channel 24 is generally formed through a central portion of the ground plate 16 and extends from an end 26 proximate the charge electrode 14 to an edge 28 proximate the catcher 20. The depth and width of the channel 24 may be greater at the end 26 than at the edge 28. That is, the depth and width of the channel 24 may decrease from the end 26 to the edge 28. The continual decrease from the end 26 to the edge 28 promotes increased liquid velocity as the liquid (such as ink and/or makeup fluid) moves from the end 26 to the edge 28.

Alternatively, the channel 24 may be formed such that it extends from an edge 30 proximate the charge electrode 14 to the edge 28. Also, alternatively, the channel 24 may be formed such that it extends from a point further within the body of the ground plate 16 to the edge 28. For example, the channel 24 may extend from a midpoint of the ground plate 16 to the edge 28.

Figure 4:
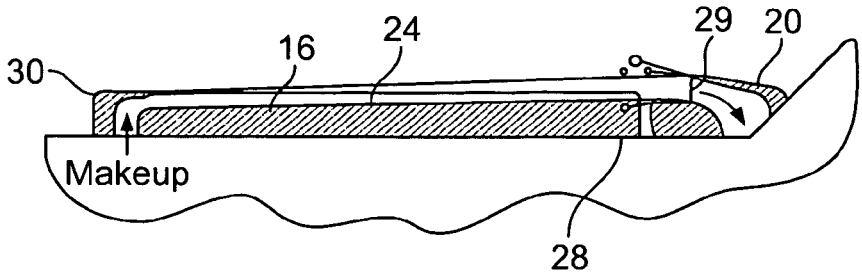
FIG. 4 illustrates a transverse cross-sectional view of a catcher and ground plate along line 4—4 of FIG. 3 according to an embodiment of the present invention.

FIG. 4 illustrates a transverse cross-sectional view of the catcher 20 and the ground plate 16 along line 4—4 of FIG. 3. Before and/or after a printing process, the catcher 20 and the ground plate 16 may be cleaned. In this respect, the print head 10 may automatically transition into a cleaning mode when not in a printing mode. For example, the catcher 20 and the ground plate 16 may be automatically cleaned when the ink jet printer is turned on, or before the ink jet printer is turned off. Alternatively, the components of the print head 10 may be intermittently cleaned while the ink jet printer is operative, e.g., between print cycles. The system may also be constructed to allow manual operation of the cleaning mode, e.g., via a user interface such as a switch or control panel.

Before and/or after a printing mode or cycle, pressurized makeup fluid, i.e., cleaning solvent, is discharged into the channel 24. As the makeup fluid flows through channel, it picks up and washes out residue and ink deposits from the channel 24. The makeup fluid is sucked into a mouth 29 of the catcher 20 through the vacuum emanating through the catcher 20. Thus, the channel 24, the mouth 29 and the catcher passage (not shown) are cleaned as the makeup fluid passes therethrough. While the ground plate 16 is shown as substantially planar, the ground plate 16 may include sides that are angled up from the channel 24.

Figure 5:
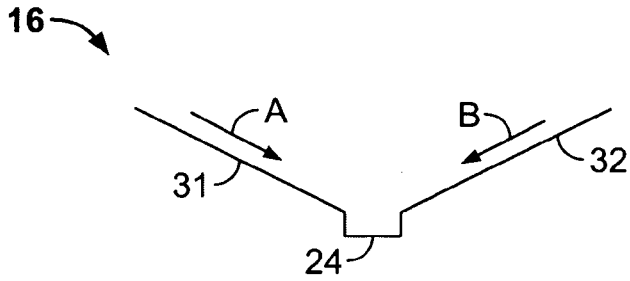
FIG. 5 illustrates an edge view of a ground plate according to an alternative embodiment.

FIG. 5 illustrates an edge view of the ground plate 16 according to an alternative embodiment. The channel 24 may be the lowest portion of the ground plate 16 such that makeup fluid, ink, and other fluids may flow downwardly into the channel 24. As such, makeup fluid that is discharged onto the sides 31, 32 of the ground plate 16 may flow down in the directions of A and B toward the channel 24, by way of gravity, thereby cleaning the upper portions of the ground plate 16.

Figure 6:
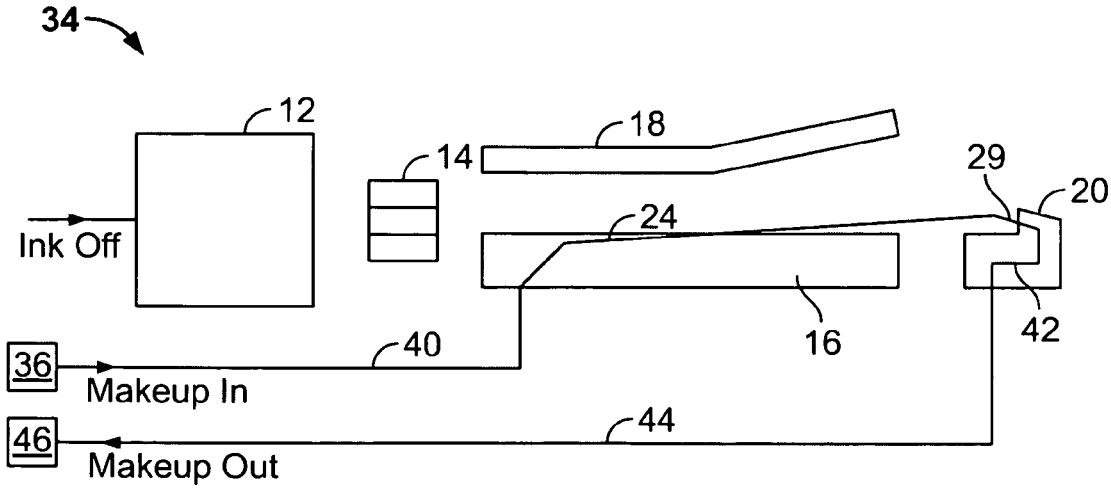
FIG. 6 illustrates a schematic representation of a print head cleaning system for an ink jet printer according to an embodiment of the present invention.

FIG. 6 illustrates a schematic representation of a print head cleaning system for an ink jet printer. During the cleaning mode, makeup fluid is discharged from a makeup (i.e., solvent) supply system 36 through a makeup conduit 40. The makeup fluid then passes from the makeup conduit 40 into the channel 24 of the ground plate 16, as described above. The vacuum assisted catcher 20 then suctions the makeup fluid (along with the removed ink deposits and residue) through the mouth 29 and into a catcher passage 42. The fluid is then passed from the catcher passage 42 into a makeup conduit 44. The fluid then flows through the makeup conduit 44 into the makeup (i.e., solvent) return system 46. Optionally, the makeup conduit 44 may feed directly into the ink reservoir (not shown), as opposed to the solvent return system. The ink reservoir may include separate chambers for recycled ink and recycled makeup fluid. As discussed above, the above-described cleaning process may occur when the ink jet printer is initially powered on and/or before the ink jet printer is powered off. Alternatively, the cleaning process may occur intermittently between printing cycles.

Preferably, the makeup supply and return system 36 and 46 may be separate and distinct from the makeup supply and return systems used to supply makeup fluid for the drop generator 12. Optionally, the makeup supply and return systems 36 and 46 may be used to supply makeup fluid to clean the front face of the drop generator 12, as shown and described in U.S. Pat. No. 6,5757,556, and to the ground plate 16, as discussed above. For example, a split conduit may be used to supply makeup fluid directly to the channel 24 of the ground plate 16 and the drop generator 12. In either case, makeup fluid is supplied directly to the channel 24 of the ground plate 16.

Figure 7:
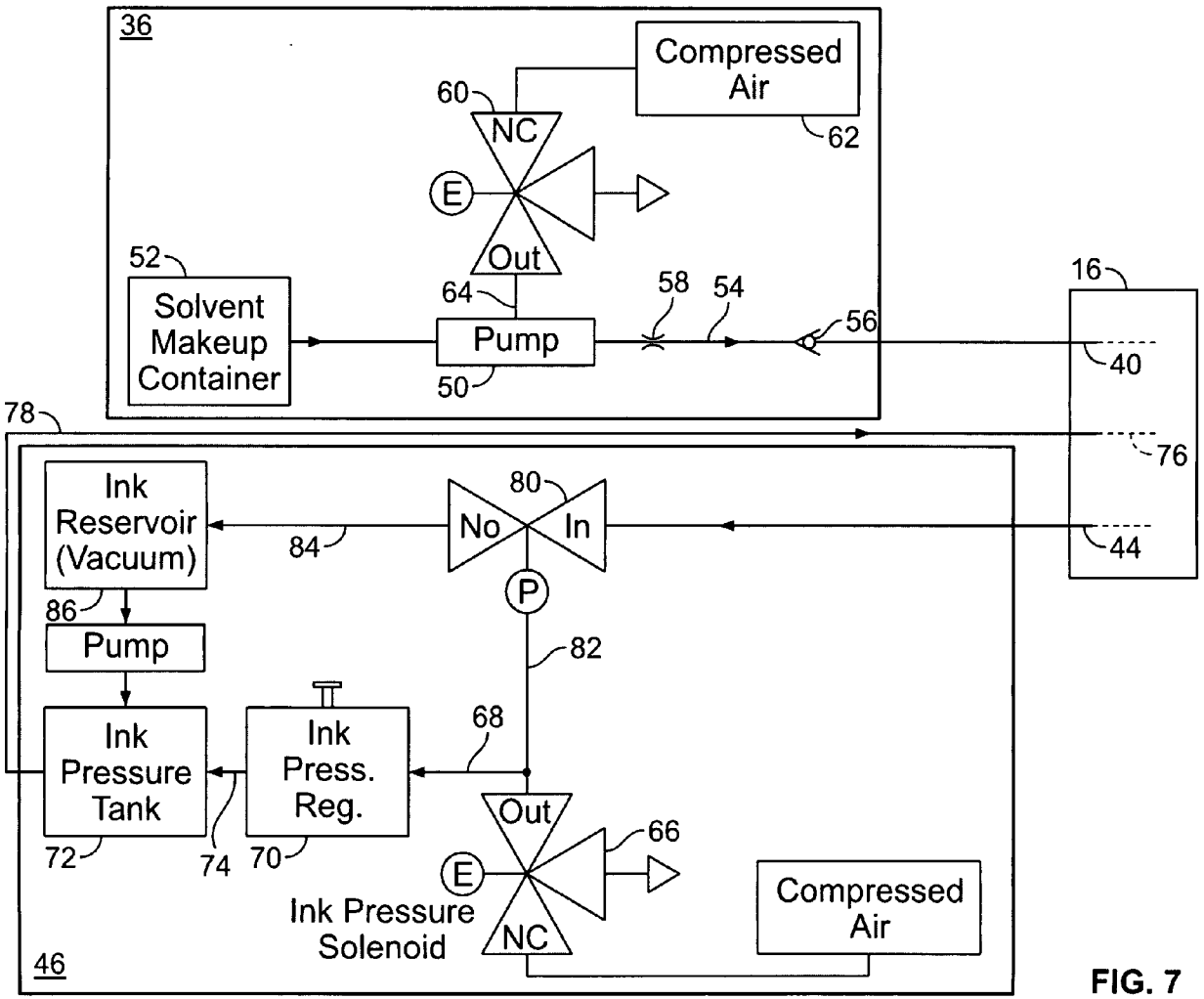
FIG. 7 illustrates a schematic representation of a solvent circulation system according to an embodiment of the present invention.

FIG. 7 illustrates a schematic representation of a makeup fluid circulation system according to an embodiment of the present invention. The makeup supply system 36 includes a pump 50 that draws the makeup fluid from a solvent makeup container 52, through a conduit 54, to the makeup conduit 40, and onto the channel 24 of the ground plate 16. Within the conduit 54, the makeup fluid may flow through a check valve 56, and may also flow through an alternative flow restrictor 58 connected in the makeup supply system 36. The flow restrictor 58 may be provided to regulate the flow of makeup fluid through adjustment of the solvent supply pressure. The makeup supply system 36 also includes a valve 60 for providing compressed air 62 through conduit 64 and to the pump 50. The pump 50 uses the compressed air 62 to force or push the makeup fluid through the makeup conduit 40 into the channel 24 of the ground plate 16. Alternatively, other known pumping systems that do not use compressed air may be used.

The makeup return system 46 has an ink pressure solenoid-activated valve 66 (hereafter, referred to merely as ink pressure solenoid 66) connected through conduit 68 to an ink pressure regulator 70, which in turn is connected to an ink pressure tank 72 though conduit 74. The ink pressure tank 72 is also connected to main conduit 76 through conduit 78. Ink pressure solenoid 66 also connects with a valve 80 through conduit 82. The valve 24 may connect to a conduit 84 that opens to the ink reservoir 86.

For the cleaning process (preferably before start-up, after shutdown or during maintenance operations), the ink supplied to the main conduit 76 is shut off by de-energizing the ink pressure solenoid 66 to de-pressurize the ink pressure tank 46, which turns off the ink stream. This permits used makeup fluid and residue ink from the channel 24 of the ground plate 16 and the catcher 20 to be placed in the ink reservoir 40. As the total amount of makeup fluid added to the ink system during cleaning is relatively small, ink composition control is substantially unaffected by the cleaning operation.

Shortly after ink pressure solenoid 66 is de-energized, valve 60 is energized. This allows compressed air 62 to flow through conduit 64 to air operated pump 50, which pumps the makeup fluid through conduit 54 and check valve 56. Check valve 56 is of sufficient opening or cracking pressure to keep the makeup conduit 40 clear of low pressure liquid and to prevent reverse or back flow. From conduit 54, the makeup supply system 36 supplies makeup fluid under pressure to the channel 24 of the ground plate 16 through makeup conduit 40. The flow of makeup fluid through the channel 24 of the ground plate 16 may be uniform, or pulsating. The type of flow depends on its supply pressure mechanism. For example, different pump restrictions or pump control systems can provide either uniform or pulsed fluid pressures, thus providing either uniform or pulsating makeup fluid flow.

While the flow of makeup fluid dissolves residue, ink accumulations and any other particles in the channel 24 and catcher 20, the makeup fluid is suctioned into makeup conduit 44 to the makeup return system 46. After a predetermined cleaning time, valve 60 is de-energized to stop the flow of compressed air 62 and turn off pump 50, thereby stopping the flow of makeup fluid.

Optionally, the makeup return system 46 may not include any ink related components and may, instead, include only components to receive makeup fluid and recycle the makeup fluid. Also, alternatively, the system may not be connected to the main conduit 76. Further, the conduits 78 and 40 may include split portions that allow makeup fluid to pass to the ground plate 16 and the drop generator 12.

Alternatively, embodiments of the present invention may provide a direct connection between the makeup supply system 36 and the catcher 20. For example, a conduit may extend from the makeup supply system directly to the mouth of the catcher 20. The mouth 28 of the catcher 20 would receive makeup fluid from the conduit and ink deposits from the drop generator. In other words, while a conduit may connect to the mouth 28, the mouth 28 is still open to receive ink deposits.

Thus, embodiments of the present invention provide a print head for an ink jet printer that automatically and efficiently cleans components of the print head, such as the ground plate and the catcher. As such, interruptions due to manual cleaning of these components are reduced or eliminated.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A self-cleaning print head for an ink jet printer that directs ink to a substrate to be marked, the print head comprising:

a ground plate a channel formed through said ground plate; and a makeup fluid supply system that supplies makeup fluid directly to said ground plate through a makeup supply conduit, said makeup fluid formulated to remove ink residue from said channel as said makeup fluid flows through said channel.

2. The self-cleaning print head of claim 1, further comprising a catcher, said catcher receiving said makeup fluid that flows through said channel.

3. The self-cleaning print head of claim 2, wherein at least one of a depth and width of said channel is not constant.

4. The self-cleaning print head of claim 2, further comprising a makeup return system operatively connected to said catcher through a makeup return conduit, said makeup fluid flowing through said makeup return conduit to said makeup return system.

5. The self-cleaning print head of claim 1, further comprising a drop generator and a generator supply conduit, wherein said makeup fluid is directly supplied to said drop generator through said generator supply conduit, and wherein said makeup fluid is directly supplied to said ground plate through said makeup supply conduit.

6. The self-cleaning print head of claim 1, wherein said ground plate further comprises elevated side portions connected to a channel, wherein said makeup fluid is discharged over said side portions and flows downwardly to said channel.

7. The self-cleaning print head of claim 1, wherein said makeup fluid is supplied to said ground plate at least one of before and after a printing cycle.

8. The self-cleaning print head of claim 5, wherein said makeup fluid is supplied to said drop generator through a separate makeup fluid supply system.

9. A self-cleaning print head for an ink jet printer that directs ink to a substrate to be marked, the print head comprising:

a drop generator for providing a droplet stream toward a substrate during a printing cycle;

a charge electrode for selectively charging ink droplets in said droplet stream during the printing cycle;

a deflection plate and a ground plate having a channel formed therein, wherein an electrostatic field is formed between said deflection plate and said ground plate to deflect charged droplets of ink toward the substrate during the printing cycle;

a catcher for receiving uncharged droplets of ink during the printing cycle; and a makeup fluid supply system that supplies makeup fluid directly to said ground plate through a makeup supply conduit during a cleaning cycle, said makeup fluid formulated to remove ink residue from said channel as said makeup fluid flows through said channel.

10. The self-cleaning print head of claim 9, wherein said catcher receives said makeup fluid that flows through said channel during the cleaning cycle.

11. The self-cleaning print head of claim 9, further comprising a makeup return system operatively connected to said catcher through a makeup return conduit, said makeup fluid flowing through said makeup return conduit to said makeup return system.

12. The self-cleaning print head of claim 9, further comprising a generator supply conduit, wherein said makeup fluid is directly supplied to said drop generator through said generator supply conduit, and wherein said makeup fluid is directly supplied to said ground plate through said makeup supply conduit.

13. The self-cleaning print head of claim 9, wherein said ground plate further comprises elevated side portions connected to said channel, wherein said makeup fluid is discharged over said side portions and flows downwardly to said channel.

14. The self-cleaning print head of claim 9, wherein the cleaning cycle occurs at least one of before and after a printing cycle.

15. The self-cleaning print head of claim 9, wherein said makeup fluid is supplied to said drop generator through a separate makeup fluid supply system.

16. A method of automatically cleaning a print head of an ink jet printer comprising:

directly supplying makeup fluid to a ground plate in order to remove ink droplet residue from the ground plate; and suctioning the makeup fluid from the ground plate to a catcher, wherein the makeup fluid removes ink droplet residue from the catcher.

17. The method of claim 16, further comprising passing the makeup fluid from the catcher to a makeup return system through a makeup return conduit.

18. The method of claim 16, further comprising directly supplying makeup fluid to a drop generator and to the ground plate.

19. The method of claim 16, wherein said directly supplying step occurs before a printing cycle.

20. The method of claim 16, wherein said directly supplying step occurs after a printing cycle.

21. The self-cleaning print head of claim 16, wherein said directly supplying makeup fluid to the drop generator and the ground plate occurs through separate and distinct makeup fluid supply systems.

* * * * *